US009687952B2

(12) United States Patent
Xie et al.

(10) Patent No.: US 9,687,952 B2
(45) Date of Patent: Jun. 27, 2017

(54) INTELLIGENT GRINDING DEVICE FOR SHORT PULSE ELECTRICAL MELT CHIP REMOVAL COOLING

(71) Applicant: SOUTH CHINA UNIVERSITY OF TECHNOLOGY, Guangdong (CN)

(72) Inventors: Jin Xie, Guangdong (CN); Yanjun Lu, Guangdong (CN); Zhenjie Deng, Guangdong (CN); Jiahui You, Guangdong (CN); Xianhai Si, Guangdong (CN); Jian Cheng, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 15/300,772

(22) PCT Filed: Dec. 31, 2015

(86) PCT No.: PCT/CN2015/100143
§ 371 (c)(1),
(2) Date: Sep. 29, 2016

(87) PCT Pub. No.: WO2016/145926
PCT Pub. Date: Sep. 22, 2016

(65) Prior Publication Data

US 2017/0014967 A1 Jan. 19, 2017

(30) Foreign Application Priority Data

Mar. 19, 2015 (CN) ..... 2015 1 0122468

(51) Int. Cl.
*B24B 27/06* (2006.01)
*B24B 49/10* (2006.01)
(Continued)

(52) U.S. Cl.
CPC ..... *B24B 27/06* (2013.01); *B24B 49/10* (2013.01); *B24B 49/14* (2013.01); *B24B 55/02* (2013.01); *B24B 55/06* (2013.01)

(58) Field of Classification Search
CPC ..... B24B 27/06; B24B 49/10; B24B 49/14; B24B 55/02
(Continued)

(56) References Cited

U.S. PATENT DOCUMENTS 3,886,695 A * 6/1975 Elbe ..... B24B 9/167 269/310
3,916,573 A * 11/1975 Elbe ..... B24B 9/167 451/269
(Continued)

FOREIGN PATENT DOCUMENTS

CN 101491882 7/2009
CN 102490121 6/2012
(Continued)

OTHER PUBLICATIONS

"International Search Report (Form PCT/ISA/210)", mailed on Mar. 4, 2016, with English translation thereof, pp. 1-4.

*Primary Examiner* — Eileen Morgan
(74) *Attorney, Agent, or Firm* — Jianq Chyun IP Office

(57) ABSTRACT

An intelligent grinding device for short pulse electrical melt chip removal cooling, includes a diamond grinding wheel, a pulse power supply, a force meter sensor, thermocouple in a hole of work piece for measuring machining temperature, a voltage sensor, a current sensor, a temperature collecting card, a charge amplifier, a force meter, a digital oscilloscope and a discharge parameter feedback adjustment system. The pulse power supply has a positive pole connecting with the grinding wheel, and a negative pole connecting with the work piece. The voltage sensor and the current sensor respectively put collected discharge voltage and current
(Continued)

wave of the discharge circuit to be stored in a display terminal through the digital oscilloscope. The thermocouple connects with the display terminal by the temperature collecting card.

5 Claims, 2 Drawing Sheets

(51) Int. Cl.
*B24B 49/14* (2006.01)
*B24B 55/02* (2006.01)
*B24B 55/06* (2006.01)

(58) Field of Classification Search
USPC ..... 451/5, 8, 53, 449
See application file for complete search history.

(56) References Cited

U.S. PATENT DOCUMENTS

2009/0186558 A1* 7/2009 Ori ..... B24B 53/001
451/21
2012/0175938 A1* 7/2012 Arcona ..... B24B 7/188
299/39.4

FOREIGN PATENT DOCUMENTS

| | | |
|---|---|---|
| CN | 103395002 | 11/2013 |
| CN | 104742002 | 7/2015 |
| CN | 204584931 | 8/2015 |
| JP | 2009172707 | 8/2009 |
| JP | 5107733 | 12/2012 |

* cited by examiner

INTELLIGENT GRINDING DEVICE FOR SHORT PULSE ELECTRICAL MELT CHIP REMOVAL COOLING

CROSS-REFERENCE TO RELATED APPLICATION

This application is a 371 application of an international PCT application serial no. PCT/CN2015/100143, filed on Dec. 31, 2015, which claims priority to and the benefit of China Patent Application No. CN201510122468.2, filed on Mar. 19, 2015, the disclosure of which is incorporated herein by reference in its entirety.

FIELD OF THE INVENTION

The present invention relates to a precise grinding area of superhard diamond grinding wheel, and more particularly relates to a precise discharge grinding technology for hard brittle materials such as die steel, engineering ceramic and hard alloy.

BACKGROUND OF THE INVENTION

High performance conductive hard brittle materials such as die steel, engineering ceramic and hard alloy is applied extensively, which has high hardness, low breaking tenacity, and is hard to be machined to high quality surface. Traditional mechanical cutting does not only have high requirement for the combined performance of tools, but also have questions for example large cutting force, high cutting temperature, low quality of machined surface. As the conductive hard brittle materials, many new machining methods appear recent years, for example electrical spark machining, laser machining, electrical chemical erosion machining. But the machining methods have low quality of machined surface, high production cost, and erosion fluid and cooling fluid which is difficult to deal.

Hence, a short pulse discharge grinding method is used, which melts cuttings by pulse electrical spark produced by grind wheel's metallic bond and cuttings, making molten cuttings be removed by high speed rotation wheel.

SUMMARY OF THE INVENTION

The main purpose of the present invention is to overcome deficiencies in traditional machining process, for example high grinding temperature, large grinding force, grinding cooling fluid polluting environment, and low quality of surface machining, and to provide an intelligent grinding device for short pulse electrical melt chip removal cooling, which is precise discharge grinding technology for high performance conductive hard brittle materials such as die steel, engineering ceramic and hard alloy. The intelligent grinding device does not need grinding fluid, and is a green environmental-protective machining device. An online collection system for discharge wave, grinding temperature and grinding force is also provided. The device can self-adaptively feedback and adjust output voltage and current parameter of pulse power supply according to collected discharge parameters, performing intelligent discharge grinding.

The invention can be implemented by technical solution below.

An intelligent grinding device for short pulse electrical melt chip removal cooling, includes a diamond grinding wheel fixed on a grinding wheel shaft of a CNC grinding machine, a pulse power supply, a force meter sensor fixed on a horizontal work table of the CNC grinding machine, thermocouple in a hole of work piece for measuring machining temperature, a voltage sensor, a current sensor, a temperature collecting card, a charge amplifier, a force meter, a digital oscilloscope, and a discharge parameter feedback adjustment system. The diamond grinding wheel is a metallic bond diamond grinding wheel. The pulse power supply has a positive pole connecting with the grinding wheel, and a negative pole connecting with the work piece, forming a discharge circuit. The voltage sensor and the current sensor respectively put collected discharge voltage and current wave of the discharge circuit to be stored in a display terminal through a digital oscilloscope. The thermocouple connects with the display terminal by the temperature collecting card, and the force meter sensor connects in sequence with the charge amplifier, the force meter and the display terminal. The discharge parameter feedback adjustment system is used for self-adaptively adjusting voltage and current value of the pulse power supply according to pulse discharge parameters including peak current, pulse continuous time, which are transformed by collected voltage and current wave characteristics, performing intelligent discharge grinding.

Further, open-circuit voltage of the pulse voltage is 20V-25V, duty cycle is 40%-50%, and frequency is 4000 Hz-5000 Hz. Discharge gap of the pulse sparkle is 0~150 μm, pulse width is 10~100 microsecond, and current is 0~10 A.

Further, rotation speed of the diamond grinding wheel is 20~50 m/s, feed depth is 1~10 μm, and feed speed is 100~500 mm/minute.

Further, material of the work piece may be conductive hard brittle materials such as die steel, hard alloy, titanium alloy, Al—SiC.

Further, metallic bond of the diamond grinding wheel may be bronze bond, diamond grains and the bronze bond forming the diamond grinding wheel.

In this invention, the diamond grinding wheel is fixed on the grinding wheel shaft of the CNC grinding machine, and the conductive hard brittle work piece is put on the force meter sensor and is also fixed on the horizontal work table of the digital grinding machine. The thermocouple is put on the hole of the work piece. The diamond grinding wheel, work piece and the pulse power supply form discharge circuit. The positive pole of the pulse power supply connects with the grinding wheel, and the negative pole of the pulse power supply connects with the work piece. The diamond grinding wheel takes straight reciprocating motion. When the diamond grains cut the work piece, pulse electrical spark discharge occurs between curled cuttings and metallic bond of the grinding wheel, and may melt the cuttings instantly (shown in FIG. 3). The melt cuttings may be expelled with high speed rotating grinding wheel, reducing cuttings stack and slip in cutting area, resulting in decreasing grinding force and grinding temperature during grinding machining process, realizing cuttings cooling and increasing machining quality of the material surface. In process of the discharge grinding, the current sensor, the voltage sensor and the digital oscilloscope may online collect current and voltage wave, in realtime collect grinding temperature through the thermocouple, the temperature collecting card and the display terminal, and in realtime collect grinding force through the force sensor, the charge amplifier, the force meter and the display terminal.

The diamond grinding wheel takes straight reciprocating motion, and contacts discharge cutting with the conductive hard brittle materials. Speed of the diamond grinding wheel is 20~50 m/s, feed depth is 1~10 μm, and feed speed is 100~500 mm/minute. Open-circuit voltage of the pulse voltage is 20V-25V, duty cycle is 40%-50%, and frequency is 4000 Hz-5000 Hz.

The invention has following advantage compared with prior art:

(1) Under 20~25V open-circuit voltage, continuous pulse electrical spark discharge is generated between the diamond grinding wheel and the conductive hard brittle materials, making the cuttings melt instantly and expelled with the high speed rotating grinding wheel, and reducing grinding force and grinding temperature compared with traditional mechanical grinding methods.

(2) Compared with traditional mechanical grinding methods, extra cooling fluid is not needed, this invention provides a low cost, green and environmental-protective grinding method.

(3) Compared with traditional mechanical grinding methods, this invention intelligently adjusts pulse electrical power supply parameters through discharge parameter feedback adjustment system, achieving higher quality surface.

1—diamond grinding wheel, 2—work piece, 3—thermocouple, 4—force meter sensor, 5—horizontal work table, 6—temperature collecting card, 7—charge amplifier, 8—force meter, 9—display terminal, 10—pulse electrical power supply, 11—current sensor, 12—voltage sensor, 13—digital oscilloscope, 14—discharge parameter feedback adjustment system, 15—diamond grains, 16—metallic bond, 17—cuttings, 18—pulse electrical spark discharge, 19—moltencuttings.

DESCRIPTION OF THE PREFERRED EMBODIMENTS

The present invention will be further described combined with accompanied drawings and detailed embodiments for better understanding this invention. The scope of the invention claims is not limited in the scope shown by the embodiments.

Figure 1:
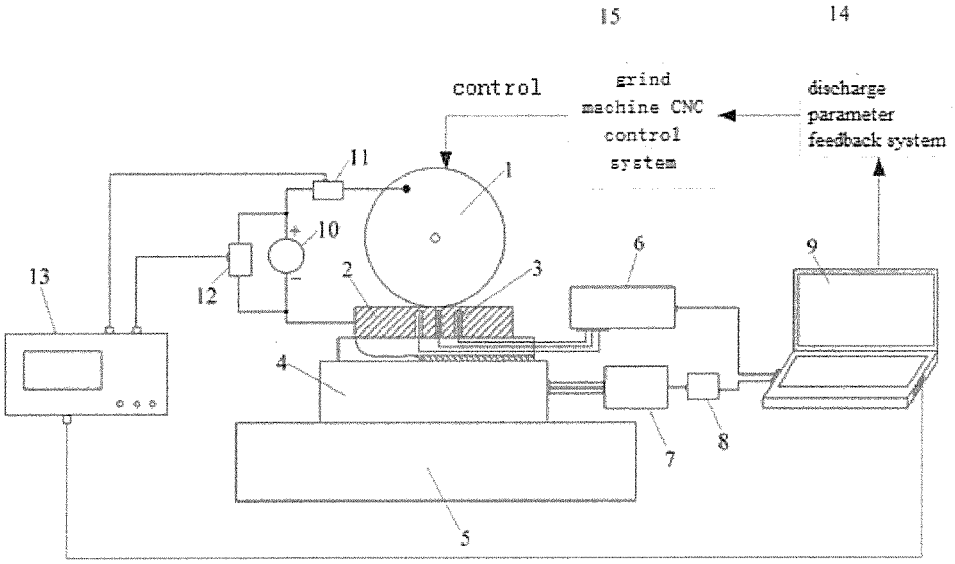
FIG. 1 is a schematically overall structural view of an embodiment 1 of the invention.

As shown in FIG. 1, a grinding device with short pulse electrical melt chip removal cooling, includes a diamond grinding wheel 1 fixed on a grinding wheel shaft of a CNC grinding machine, a pulse power supply 10, a force meter sensor 4 fixed on a horizontal work table 5 of a CNC grinding machine, thermocouple 3 in a hole of work piece 2 for measuring machining temperature, a voltage sensor 12, a current sensor 11, a temperature collecting card 6, a charge amplifier 7, a force meter 8 and a digital oscilloscope 13. The diamond grinding wheel 1 is a metal-bond diamond grinding wheel. The pulse power supply 10 has a positive pole connecting with the grinding wheel 1, and a negative pole connecting with the work piece 2, forming a discharge circuit. The voltage sensor 12 and the current sensor 11 respectively put collected discharge voltage and current wave of the discharge circuit to be stored in a display terminal 9 through a digital oscilloscope 13. The thermocouple 3 connects with the display terminal 9 by the temperature collecting card 6, and the force meter sensor 4 connects in sequence with the charge amplifier 7, the force meter 8 and the display terminal 9. The discharge parameter feedback adjustment system 14 is used for self-adaptively adjusting voltage and current value of the pulse power supply 10 according to pulse discharge parameters, such as peak current, pulse continuous time, which is transformed by collected voltage and current wave characteristics, performing intelligent discharge grinding.

During operation, the diamond grinding wheel is fixed on a grinding wheel shaft of the CNC machine, and the conductive hard brittle materials 2 is put on the force meter sensor 4 and is also fixed on the horizontal work table 5 of the CNC machine. The thermocouple 3 is put on a hole of the work piece 2 (close to surface of the work piece). The diamond grinding wheel 1, the work piece 2 and the pulse power supply 10 form discharge circuit. The pulse power supply 10 has a positive pole connecting with the grinding wheel 1, and a negative pole connecting with the work piece 2. The diamond grinding wheel 1 takes straight reciprocating motion on surface of the work piece 2. Micrometer size between metallic bond 16 of the diamond grinding wheel 1 and the work piece 2 is 5-200 μm. The micrometer size discharge gap of metallic bond 16 and the work piece cuttings is 2-150 μm.

Figure 2:
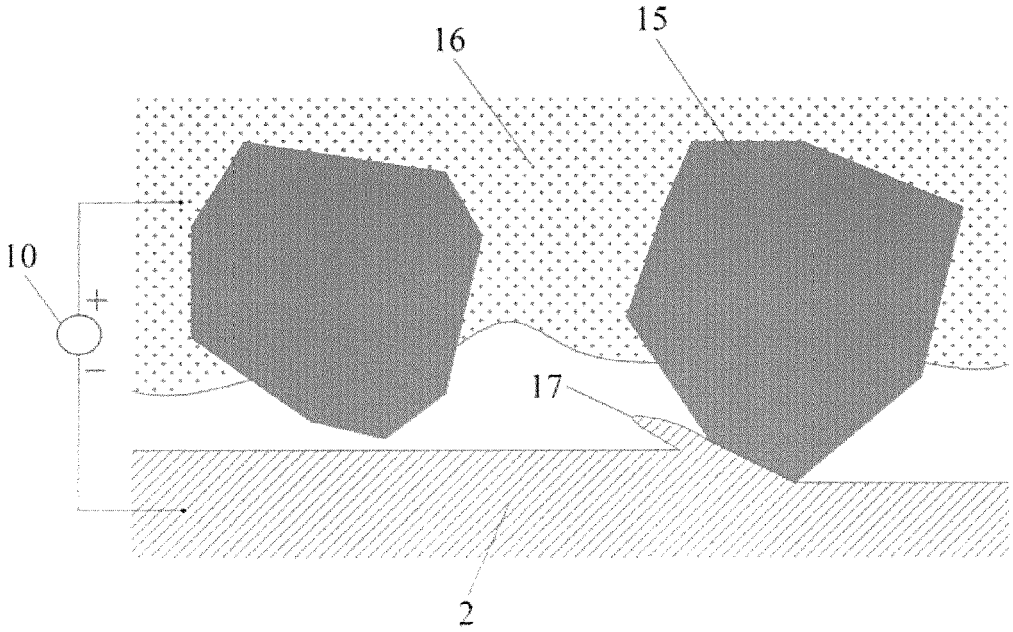
FIG. 2 is a schematic view of formation of cuttings during mechanical grinding.
Figure 3:
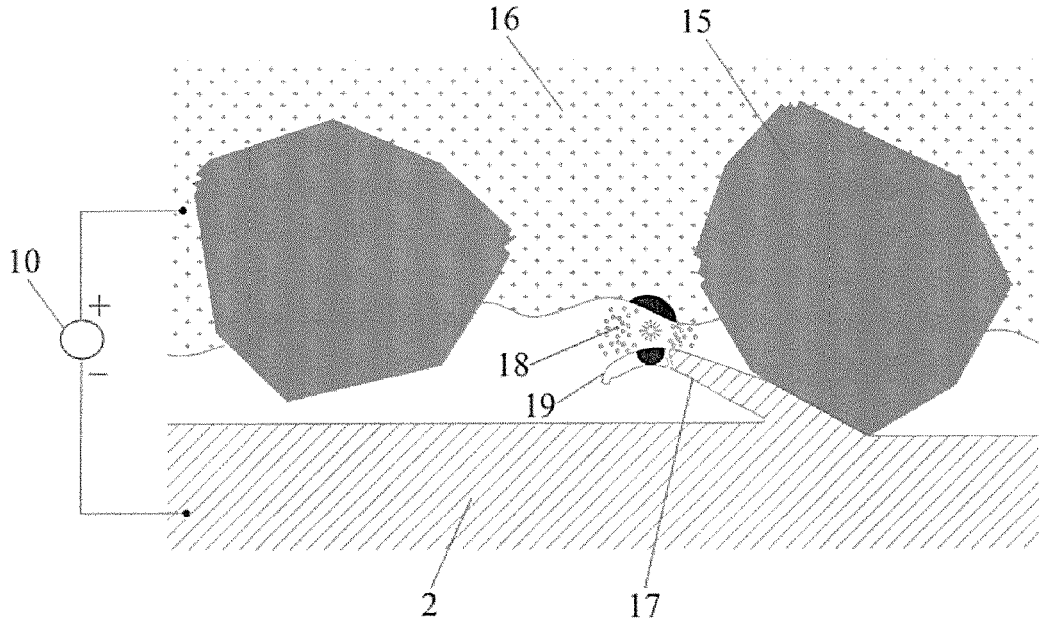
FIG. 3 is a schematic view of formation of cuttings during discharge grinding.

When the diamond grains 15 cut the work piece 2 (shown in FIG. 2), pulse electrical spark discharge 18 occurs between curled cuttings 17 and metallic bond 16 of the grinding wheel 1, and may melt the cuttings 17 instantly (shown in FIG. 3). The moltencuttings 17 may be expelled with high speed rotating grinding wheel 1, reducing cuttings 17 stack and slip in grinding area, resulting in decreasing grinding force and grinding temperature during grinding process, realizing cuttings cooling and increasing machined quality of the material surface. In process of the discharge grinding, the current sensor 11, the voltage sensor 12 and the digital oscilloscope 13 may online collect current and voltage wave. The display terminal 9 transforms the voltage and current wave characteristics to pulse discharge parameters, such as peak current and pulse continuous time, and to be input to the discharge parameter feedback adjustment system 14. The discharge parameter feedback adjustment system 14 self-adaptively adjusts discharge parameters, for example voltage and current, of the pulse power supply 10, and intelligently controls discharge grinding process. Grinding temperature may be in realtime collected through thermocouple 3, temperature collecting card 6 and the display terminal 9, and grinding force may be in realtime collected through the force sensor 4, charge amplifier 7, force meter 8 and the display terminal 9.

The diamond grinding wheel 1 takes straight reciprocating motion on the surface of the work piece 2 and machining the work piece 2 with contact discharge. The diamond grinding wheel 1 has rotation speed 2000~5000 rotation/minute, feed depth 1~10 micrometer, and feed speed 100~300 μm/minute. The open-circuit voltage of the pulse voltage 10 is 20V-25V, duty cycle is 40%-50%, and frequency is 4000 Hz-5000 Hz.

During short pulse contact discharge machining process, if appropriate pulse open-circuit voltage, duty cycle and frequency is chosen, and appropriate rotation speed of the diamond grinding wheel 1, feed depth and feed speed is provided, nonconductive diamond grains of micro cutting edge generates micro size space between the metallic bond 16 and the work piece 2, a certain pulse empty load voltage is applied between conductive metallic bond 16 and the work piece 2, using the electrical conductivity of the metallic bond 16 and the work piece 2 to adjust empty load voltage, pulse frequency and duty cycle, to control micro size discharge gap, making metallic bond 16 of the diamond grinding wheel 1 and cuttings 17 of the work piece 2 generate short pulse spark discharge. High temperature instantly makes the micrometer size cuttings 17 melt and expelled by gas of high speed rotating diamond grinding wheel 1, reducing cuttings 17 stack and slip in grinding area, reducing grinding force and grinding temperature during grinding process, increasing machined quality of the work piece 2 surface, which is an environmental-protective grinding method.

In an embodiment, a diamond grinding wheel 1 of diameter 150 mm, height 2.5 mm is mounted on a grinding wheel shaft of CNC precise grinding machine (SMRART B818). The work piece 2 of width 50 mm, height 12 mm is fixed on the horizontal work table 5 and is perpendicular axially to the grinding wheel. The diamond grinding wheel 1, the work piece 2 and the pulse power supply 5 form the discharge circuit. The diamond grinding wheel 1 takes #46particle size, and 100% concentration. The metallic bond 16 is bronze bond. The work piece 2 is Al—SiC.

The diamond grinding wheel 1 takes straight reciprocating motion on surface of the work piece 2. It may generate electrical sparkle between the metallic bond 16 and cuttings 17 to melt and remove the cuttings 17. The grinding wheel rotation speed is 25 m/s, feed speed is 200 mm/minute, feed depth is 2 μm. The pulse power supply open-circuit voltage is 25V, duty cycle is 50%, and frequency is 5000 Hz. Compared with traditional mechanical grinding, grinding force and grinding temperature during discharge grinding process respectively reduce about 30% and 10%, and better surface quality is achieved.

In another embodiment, a diamond grinding wheel 1 of diameter 150 mm, height 2.5 mm is mounted on a grinding wheel shaft of CNC precise grinding machine (SMRART B818). The work piece 2 of width 50 mm, height 12 mm is fixed on the horizontal work table 5 and is perpendicular axially to the grinding wheel. The diamond grinding wheel 1, the work piece 2 and the pulse power supply 5 form discharge circuit. The diamond grinding wheel 1 takes particle size #46, and 100% concentration. The metallic bond 16 is bronze bond. The work piece 2 is hard alloy.

The diamond grinding wheel 1 takes straight reciprocating motion on a surface of the material. It may generate electrical sparkle between the metallic bond 16 and cuttings 17 to melt and remove the cuttings 17. The grinding wheel rotation speed is 25 m/s, feed speed is 50 mm/minute, feed depth is 1 μm. The pulse power supply open-circuit voltage is 25V, duty cycle is 40%, and frequency is 5000 Hz. Compared with traditional mechanical grind, grind force and grinding temperature during discharge grinding process respectively reduce about 20% and 5% apparently, and coarseness of the work piece 2 surface decreases about 15%.

In a further embodiment, a diamond grinding wheel 1 of diameter 150 mm, height 2.5 mm is mounted on a grinding wheel shaft of CNC precise grinding machine (SMRART B818). The work piece 2 of width 50 mm, height 12 mm is fixed on the horizontal work table 5 and is perpendicular axially to the grinding wheel. The diamond grinding wheel 1, the work piece 2 and the pulse power supply 5 form discharge circuit. The diamond grinding wheel 1 takes particle size #46, and 100% concentration. The metallic bond 16 is bronze bond. The work piece 2 is S136H die steel.

By axial feed way, the diamond grinding wheel 1 takes surface motion axially on a surface of the work piece 2. it may generates electrical sparkle between the metallic bond 16 and cuttings 17 to melt and remove the cuttings 17. The diamond grinding wheel rotation speed is 25 m/s, feed speed is 30 mm/minute, feed depth is 5 μm. The pulse power supply open-circuit voltage is 25V, duty cycle is 40%, and frequency is 5000 Hz. Compared with traditional mechanical grinding, grinding force and grinding temperature during discharge grinding process respectively reduce about 25% and 15% apparently, and coarseness of the work piece 2 surface decreases about 30%.

While the above description constitutes a plurality of embodiments of the invention, which does not limit this invention, it will be appreciated for those skilled in the art that the present invention is susceptible to further modification, equivalent replacement and obvious change without departing from the fair meaning of the accompanying claims.

What is claimed is:

1. An intelligent grinding device for short pulse electrical melt chip removal cooling, including a diamond grinding wheel (1) fixed on a grinding wheel shaft of a CNC grinding machine, a pulse power supply (10), a force meter sensor (4) fixed on a horizontal work table (5) of the CNC grinding machine, thermocouple (3) in a hole of work piece (2) for measuring machining temperature, a voltage sensor (12), a current sensor (11), a temperature collecting card (6), a charge amplifier (7), a force meter (8), a digital oscilloscope (13) and a discharge parameter feedback adjustment system (14), the diamond grinding wheel (1) is a metal-bonded diamond grinding wheel, the pulse power supply (10) having a positive pole connecting with the grinding wheel (1), and a negative pole connecting with the work piece (2), forming a discharge circuit, the voltage sensor (12) and the current sensor (11) respectively putting collected discharge voltage and current wave of the discharge circuit to be stored in a display terminal (9) through the digital oscilloscope (13), the thermocouple (3) connecting with the display terminal (9) by the temperature collecting card (6), and the force meter sensor (4) connecting in sequence with the charge amplifier (7), the force meter (8) and the display terminal (9), the discharge parameter feedback adjustment system (14) is used for self-adaptively adjusting voltage and current value of the pulse power supply (10) according to pulse discharge parameters including peak current, pulse continuous time, which are transformed by collected voltage and current wave characteristics, performing intelligent discharge grinding.

2. The intelligent grinding device for short pulse electrical melt chip removal cooling according to claim 1, wherein open-circuit voltage of the pulse voltage (10) is 20V-25V, duty cycle is 40%-50%, frequency is 4000 Hz-5000 Hz, and discharge gap of the pulse sparkle is 0~150 μm, pulse width is 10~100 microsecond, and current is 0~10 A.

3. The intelligent grinding device for short pulse electrical melt chip removal cooling according to claim 1, wherein rotation speed of the diamond grinding wheel (1) is 20~50 m/s, feed depth is 1~10 μm, and feed speed is 100~500 mm/minute.

4. The intelligent grinding device for short pulse electrical melt chip removal cooling according to claim 1, wherein the material of the work piece (2) may be die steel, hard alloy, titanium alloy, Al—SiC.

5. The intelligent grinding device for short pulse electrical melt chip removal cooling according to claim 1, wherein the diamond grinding wheel (1) may be bronze bond.

* * * * *